United States Patent [19]

Palmer

[11] 3,948,435

[45] Apr. 6, 1976

[54] DIMENSIONALLY FIXED CONTAINER DIVIDER

[75] Inventor: Willard Palmer, Bartlett, Ill.

[73] Assignee: Clevepak Corporation, New York City, N.Y.

[22] Filed: Jan. 2, 1975

[21] Appl. No.: 537,852

[52] U.S. Cl. ..... 229/15

[51] Int. Cl.[2] ..... B65D 5/48

[58] Field of Search ..... 229/15, 21, 22, 23, 31, 229/37

[56] References Cited

UNITED STATES PATENTS

| | | | |
|---|---|---|---|
| 1,313,948 | 8/1919 | Maegly | 217/31 X |
| 2,920,782 | 1/1960 | Butters | 217/32 |
| 3,039,667 | 6/1962 | Kozlik | 229/15 |
| 3,203,612 | 8/1965 | Schaeffer | 229/15 |
| 3,343,742 | 9/1967 | Siegler | 229/15 |

*Primary Examiner*—Davis T. Moorhead
*Attorney, Agent, or Firm*—Rogers, Eilers & Howell

[57] ABSTRACT

A divider used in containers has intersecting partitions and two parallel tying strips located centrally of the divider. The tying strips hold the partitions substantially parallel so that the divider may be inserted by machine into a container and will remain in a fixed spacial relationship while the container is filled with goods by automatic casing machinery. The partitions and the tying strips have transverse cuts and are joined by interlocking the cuts in a rectilinear network. The corners of the partitions and tying strips and the openings to the cuts are relieved to allow ease of assembly of the partitions and strips and insertion of the complete divider into a container by automatic machinery. The partitions and tying strips are formed by cutting and scoring cardboard stock on conventional die cutting machines.

1 Claim, 4 Drawing Figures

DIMENSIONALLY FIXED CONTAINER DIVIDER

BACKGROUND AND SUMMARY OF THE INVENTION

Cardboard dividers are commonly used in containers, such as cardboard boxes and crates, to divide the interior of the containers into a plurality of sections for receiving protection in storage and transit. These dividers are commonly inserted in a container by automatic machines and the container carrying the divider is then filled, usually also by an automatic casing machine.

Use of automatic casing machines, in particular, has caused some difficulty with containers which have used previous cardboard dividers. The dividers must divide the interior of a container into equal volumetric sections and there must be no distortion or racking of the divider. If the divider is distorted or racked it is not possible for the casing machine to insert the articles into the case, since the articles will not index properly with the assigned space, due to the unexpected shape of the divider.

Prior dividers attempted to solve the problem of accurately positioning the divider by using a dead cell construction in which the ends of some of the partitions extended past the expected location of the articles and spaced the articles in the container from a wall of the container. The partitions were tied together by a cross partition spaced from the container wall. The dead cell construction method, having the dead cell located adjacent to one wall of the container, has some inherent drawbacks. The symmetry of the articles placed in the container is interrupted, and the presence of the dead cell at the periphery of the container weakens the container and allows weight, e.g., of other stacked containers, to collapse the dead cell portion of the container first. The dead cell portion of the container is also easily penetrated from impact or from outside forces. That is, external forces can cause penetration of the wall of the container adjacent to the dead cell.

Applicant's divider removes the dead cell from the periphery of the container and restores the symmetry of the packed articles in the container, thereby substantially lessening the possibility of penetration into the dead cell area by externally applied forces. By restoring the symmetry of the stored articles in the container, the strength of the articles stored may be utilized to increase the strength of the total container package so that there is not an area of the container at the periphery which is substantially weaker than the rest of the container.

The divider eliminates use of dead cell space at the perimeter of the container by placing two parallel tying strips centrally of the divider and spaced substantially from the periphery of the container and adjacent to each other. The tying strips interlock with the partitions of the divider to hold the partitions in a substantially parallel relationship so they are not able to rack or distort about their intended locations in the container. By using this construction, the spaces designed to be occupied by articles stored in the container are symmetrically located about the periphery of the container and there is no substantial area of weakness into which the periphery of the container can collapse or into which external forces can penetrate.

Applicant's divider may be readily manufactured, assembled and inserted in the containers using automatic machinery and is readily adapted to use in automatic casing processes. Stacking strength is also increased by the additional centrally located partitions.

DESCRIPTION OF THE PREFERRED EMBODIMENTS

Figure 1:
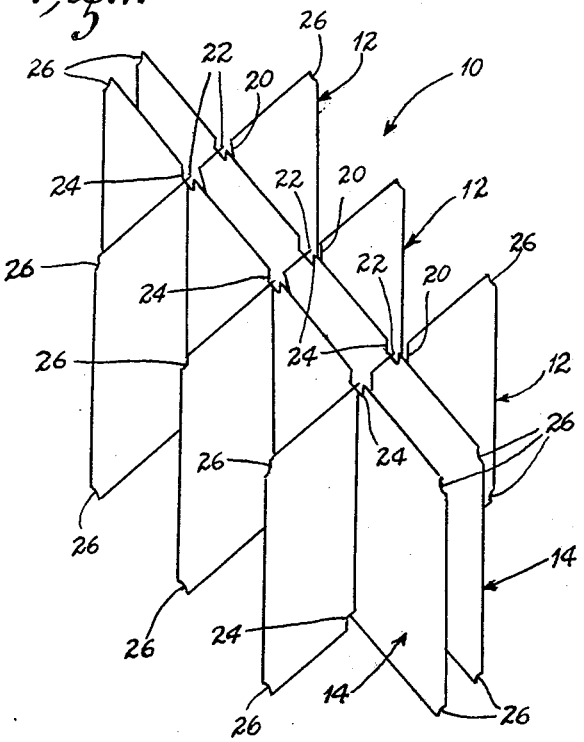
FIG. 1 is an isometric view of an assembled divider according to the invention.
Figure 2:
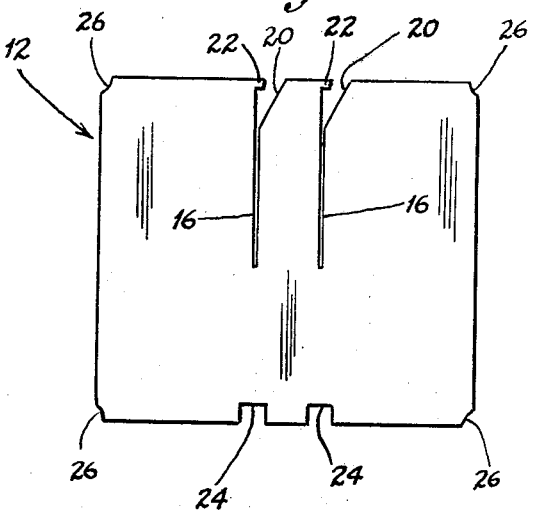
FIG. 2 is a plan view of a partition according to one aspect of the invention.

Referring in more detail to the drawings, divider 10, shown in FIG. 1, has three parallel partitions 12 and two intersecting tying strips 14 to form an eight section divider. Partitions 12, shown in FIG. 2, have two parallel slots 16 spaced adjacent to each other and spaced symetrically about the center of partition 12. Typically, slots 16 will be spaced between one to two inches apart, but may be more or less if desired. Slots 16 extend approximately halfway through the partition, as shown in FIG. 2.

Figure 3:
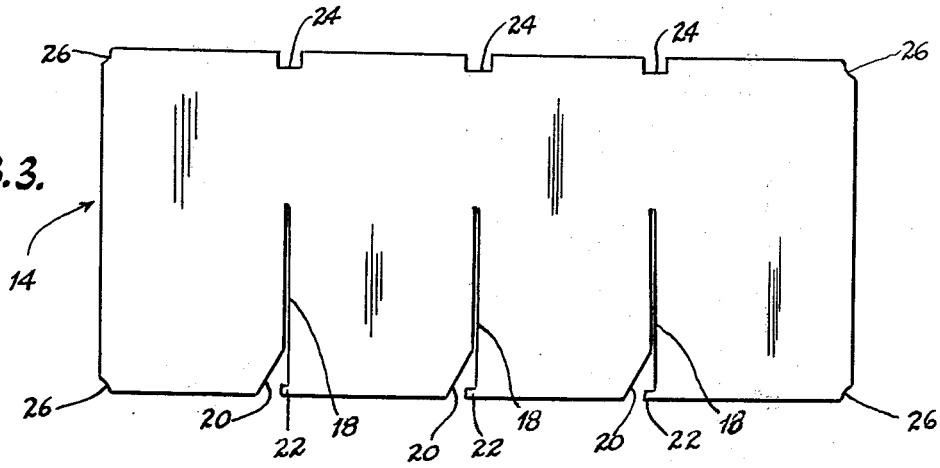
FIG. 3 is a plan view of a tying strip according to one aspect of the invention.

Tying strips 14 have three slots 18 cut partially through the tying strips 14, shown in FIG. 3, and dividing the tying strips 14 into four substantially equal areas or sections. Slots 18 also extend halfway through the vertical extension of tying strips 14. Slots 16 extend inwardly from the top portion of partitions 12 and slots 18 extend inwardly from the bottom portion of tying strips 14 so that the partitions and tying strips may be interlocked into a rectilinear network.

Partitions 12 and tying strips 14 have the entrances to slots 16 and 18 relieved by triangular cuts 20 at the upper edges of partitions 12 and the lower edges of tying strips 14 to facilitate insertion and assembly of the partitions and tying strips into the cooperating slots 16 and 18. Partitions 12 and tying strips 14 have, in addition, locking protrusions 22 at the edges of the partitions and tying strips adjacent to the entrances to slots 16 and 18. Relieved portions 24 are located at the opposite edges of partition strips 12 and tying strips 14 from the slots 16 and 18. The protrusions 22 extend across the partitions and tying strips and through the relieved portions 24 to form a lock abutting against the partitions and tying strips to prevent any substantial relative motion between the partitions and tying strips in a direction parallel to the slots 16 and 18. The cooperating means 22, 24 also restrict to some degree relative longitudinal motion perpendicular to slots 16 and 18 between partitions 12 and tying strips 14. Both partitions 12 and tying strips 14 have relieved portions 26 at their corners which permit ease of insertion of the complete assembly into a container.

Figure 4:
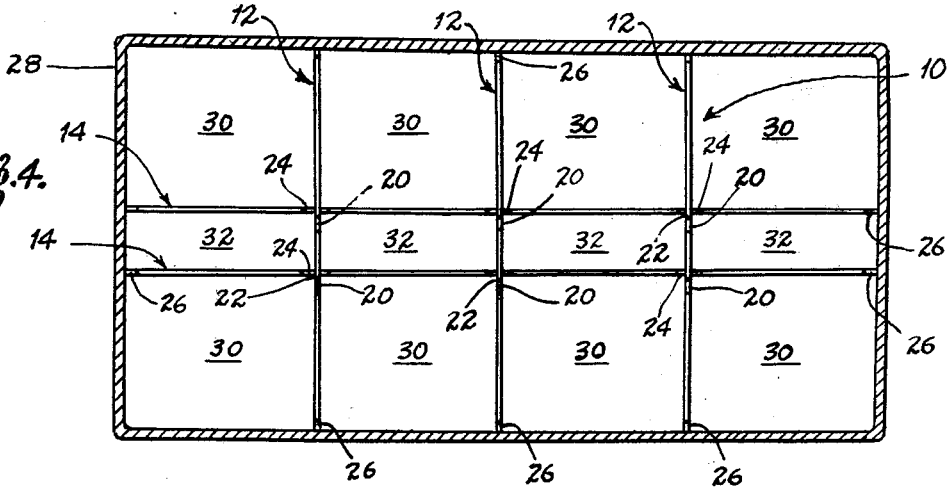
FIG. 4 is a top view partially in section of a container containing the assembled divider.

To form applicant's stabilized divider 10, elements 12 and 14 are cut by conventional methods, such as reciprocating punches and dies to form slots 16 and 18, relieved areas 20, 24 and 26, and outwardly extending portions 22. The elements 12 and 14 are then assembled with slots 16 and 18 interlocking as shown in FIG. 1. The assembled divider 10 can then be inserted in a container such as cardboard container 28, shown in FIG. 4, by an automatic machine. The tying strips 14 will hold partitions 12 in a fixed stable relationship with areas 30 maintained substantially of equal and uniform volume and size. Articles may be rapidly inserted into the areas 30 by automatic casing means. The cell areas shown at 32 are placed in the interior of the container 28 and are not spaced adjacent to a wall of the container, thus avoiding an asymetrical structure which will weaken the container. Even if cell areas 32 are crushed by overfilling areas 30, the walls of the container are not weakened.

It will be appreciated by those skilled in the art that many modifications and alternative constructions could be used incorporating the concepts of the invention without departing from the basic concepts thereof. It is intended that the invention is not to be limited by the description included herein for the purposes of illustration, but is to be limited only by the scope of the appended claims.

I claim:

1. A collapsible divider for dividing the internal spaces of a container and adapted to be inserted and removed selectively into and from a container, having a plurality of partitions extending in a first direction and means retaining the partitions in a substantially parallel relationship including at least two tying strips spaced closely adjacent in a parallel relationship symetrically about the longitudinal axis of the divider and intersecting the partitions, the partitions and tying strips having spaced slots extending partially along the vertical extensions of the partitions and tying strips and the slots of the partitions and tying strips being interlocked, the partitions and tying strips having additional interlocking and interconnecting means resisting displacement of the partitions and tying strips comprising additional tongue and recess locking means on the partitions and tying strips, the tying strips being spaced substantially inwardly from the ends of the partitions whereby the spaces between the tying strips are spaced at a location substantially remote from the walls of a container having the divider therein whereby the risk of external intrusion into the space between the tying strips is substantially eliminated, the corners of the tying strips and partitions having arcuate relieved portions to facilitate introduction and removal of the divider into and from a container.

* * * * *